United States Patent [19]

von Tluck et al.

[11] 4,217,819

[45] Aug. 19, 1980

[54] DEVICE FOR THE TRANSFER PROCESS OF CHARACTERS, CONSISTING OF TONER, THAT ARE APPLIED TO A CONTINUOUSLY ROTATING BAND-SHAPED INTERMEDIATE CARRIER

[75] Inventors: Wolfgang von Tluck, Olching; Bernhard Schlageter, Ottobrunn, both of Fed. Rep. of Germany

[73] Assignee: Siemens Aktiengesellschaft, Berlin & Munich, Fed. Rep. of Germany

[21] Appl. No.: 953,187

[22] Filed: Oct. 20, 1978

[30] Foreign Application Priority Data

Nov. 11, 1977 [DE] Fed. Rep. of Germany ..... 2750612

[51] Int. Cl.[2] ..... G03G 15/00

[52] U.S. Cl. ..... 101/1; 101/426; 101/DIG. 13; 355/3 TR

[58] Field of Search ..... 101/1 R, 426, DIG. 13; 355/3 TR

[56] References Cited

U.S. PATENT DOCUMENTS

| | | | |
|---|---|---|---|
| 3,285,168 | 11/1966 | Childress | 101/DIG. 13 |
| 3,509,816 | 5/1970 | Spaulding | 101/1 |
| 3,644,034 | 2/1972 | Nelson | 355/3 TR |
| 3,697,160 | 10/1972 | Clark | 101/DIG. 13 X |
| 3,893,761 | 7/1975 | Buchan et al. | 355/3 TR |
| 4,110,024 | 8/1978 | Gundlach | 101/DIG. 13 |
| 4,114,536 | 9/1978 | Kaneko et al. | 355/3 TR X |
| 4,131,358 | 12/1978 | Windele | 355/3 TR |
| 4,144,808 | 3/1979 | Iwasa et al. | 101/DIG. 13 |

*Primary Examiner*—E. H. Eickholt

*Attorney, Agent, or Firm*—Hill, Van Santen, Steadman, Chiara & Simpson

[57] ABSTRACT

In a copying apparatus or printing apparatus, charge images of characters to be printed are produced on a band-shaped intermediate carrier having a photoelectric layer, for example. The characters are developed with toner and are subsequently transferred to a recording carrier, for example, paper. A high percentage of the toner, situated on the intermediate carrier, is thereby to be transferred to the recording carrier. Mechanical apparatus is provided by which the intermediate carrier having the side provided with toner is brought into contact with the recording carrier during the transfer process. The intermediate carrier consists of a material of such elasticity that the area, provided therefor, can come temporarily to a stop during the transfer process. The mechanical apparatus can comprise a stationary strip which is arranged on the one side of the intermediate carrier and a movable bar arranged on the other side of the intermediate carrier.

14 Claims, 6 Drawing Figures

DEVICE FOR THE TRANSFER PROCESS OF CHARACTERS, CONSISTING OF TONER, THAT ARE APPLIED TO A CONTINUOUSLY ROTATING BAND-SHAPED INTERMEDIATE CARRIER

BACKGROUND OF THE INVENTION

1. Field of the Invention

The present invention relates to a device for the transfer process of toner images which are applied to a continuously rotating band-shaped intermediate carrier onto a recording carrier, in particular for printing equipment and copying equipment.

2. Description of the Prior Art

Printing methods are known from publications, in which images of the characters to be printed are produced on a band-shaped intermediate carrier in accordance with the electrostatic or magnetic principle, the images being subsequently developed with the aid of toners and transmitted from the band-shaped intermediate carrier onto a recording carrier which is moved perpendicularly to the band-shaped intermediate carrier. The toner images transferred to the recording carrier are subsequently melted into the recording carrier in a fixing station. The transfer process of the toner images from the intermediate carrier onto the recording carrier can proceed line-by-line. It is thereby known that the transfer of the toner images from the intermediate carrier to the recording carrier can proceed with contact under the influence of an electrostatic field or a magnetic field periodically effecting the intermediate carrier by means of the recording carrier. In this connection, one is referred to the German Offenlegungsschrift No. 2,054,262 and to U.S. Pat. No. 3,509,816.

A disadvantage of the aforementioned method lies in the lack of effectiveness during the transfer of the toner onto the recording carrier, as only a small portion of the toner, adhering to the band-shaped intermediate carrier, is transferred to the recording carrier; the main portion of the toner, however, remains on the intermediate carrier from where it must subsequently be removed.

SUMMARY OF THE INVENTION

The primary object of the present invention, therefore, is to provide a device for the transfer process of toner characters, which are applied on a continuously rotating band-shaped intermediate carrier, onto a recording carrier which is moved perpendicularly relative to the intermediate carrier, and in which a high percentage of the toner situated on the intermediate carrier is transferred onto the recording carrier during the transfer process.

The aforementioned objective is achieved in that the intermediate carrier comprises an elastic material and that mechanical apparatus is provided by means of which the intermediate carrier with the side bearing the toner is brought into contact with the recording carrier during the transfer process, whereby the area of the intermediate carrier, provided for the transfer process, comes to a standstill.

The mechanical apparatus can readily comprise a stationary strip, arranged on one side of the intermediate carrier, and a movable bar which is positioned on the other side of the intermediate carrier. The bar can be moved perpendicularly with respect to the movement of the intermediate carrier and can thereby press the intermediate carrier onto the recording carrier.

The movable bar is thereby expediently arranged adjacent to the side of the intermediate carrier which is not provided with toner. The recording carrier proceeds, then, between the strip and the side of the intermediate carrier which is provided with toner.

The movement of the bar toward and away from the intermediate carrier can thereby readily be realized with the aid of electromagnets and springs. The electromagnets, whose armatures are attached to the bar can move the bar toward the intermediate carrier, while the springs can be utilized to bring the bar back to its rest position.

Another embodiment of a device constructed in accordance with the present invention for moving the bar can comprise electromagnetic arrangements, respectively having a pressure magnet, a return magnet and a common armature. By activating the pressure magnet, the bar is moved toward the intermediate carrier; by activating the return magnet, the bar is again returned to its rest position. The return magnet, moreover, ensures that the bar remains in its rest position.

It is advantageous that the intermediate carrier, shortly before touching the recording carrier, comes to a standstill and is brought back into its direction of travel shortly after completing the contact. For this purpose, a braking member can be arranged in the strip, comprising, for example, an elastic material or a spring-supported metal block. This braking member projects over the strip and is arranged on the strip adjacent to the recording carrier. If the bar is moved toward the intermediate carrier, the intermediate carrier first strikes the brake member and thereby comes to a standstill. In the further course of the cycle, the bar then presses the intermediate carrier against the recording carrier and effects the transfer process to the intermediate carrier. The braking member is thereby compressed. During the movement in the opposite direction, the braking member is still braking the intermediate carrier, even if the contact between the intermediate carrier and the recording carrier has already been broken. It is highly advantageous to construct the braking member with a fork shape at the side facing the intermediate carrier so that it can only abut the areas of the intermediate carrier in which the intermediate carrier is not provided with toner.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
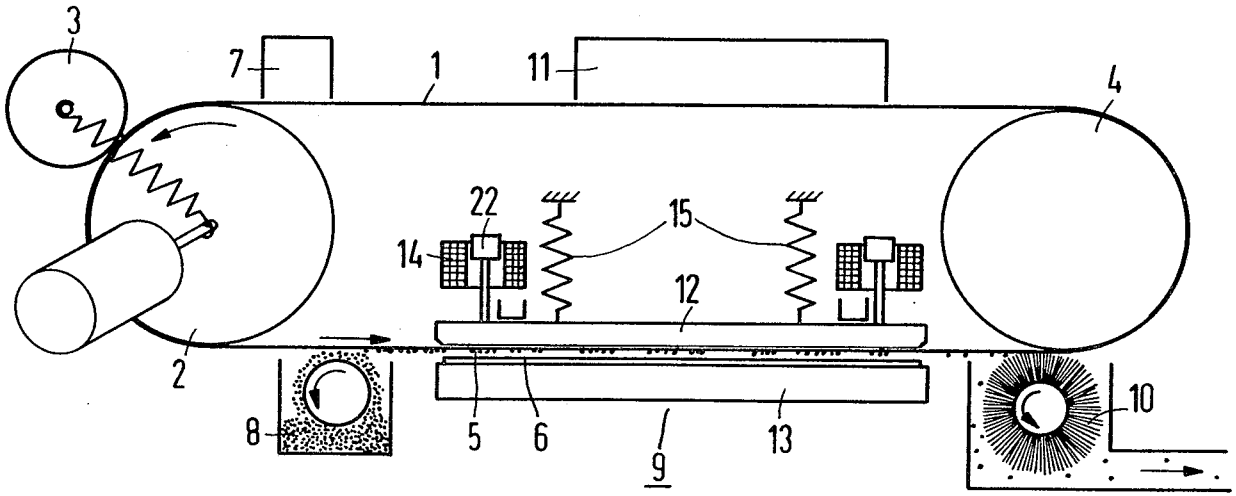
FIG. 1 is a diagrammatic view of a printing or copying apparatus having the transfer process station illustrated in accordance with its principle of operation.

Referring to FIG. 1, a printer is diagrammatically illustrated. The printer comprises a continuously rotating band-shaped intermediate carrier 1 which runs in the direction of a recording carrier 6, for example, past a web of paper. The intermediate carrier 1 is transported by a drive wheel 2, driven by a motor, with the aid of a pressure roller 3 and is thereby separated from the recording carrier 6 by means of an air gap 5.

The intermediate carrier 1 comprises an elastic synthetic material and has an electrostatically chargeable and electrostatically or electrooptically dischargeable, or a magnetizable and a demagnetizable layer on the side facing the recording carrier 6. The characters to be printed are now electrostatically or electrooptically, or electromagnetically produced in a known manner with the aid of a printer head 7 and are stored on the intermediate carrier 1 in the form of electrostatic or electromagnetic field intensity differences. These images are dyed with toner in a developer station 8 and are transferred from the intermediate carrier 1 onto the recording carrier 6 in a transfer process station 9. A rotating cleaning brush 10, having a suction device, which cleans the intermediate carrier of residual toner is arranged behind the transfer process station 9. The electrostatic or electromagnetic image, still stored on the intermediate carrier 1, is erased in a subsequent discharge or demagnetizing station 11.

The recording carrier 6 is in rest position for the duration of the transfer process. During the time in which the intermediate carrier 1, having the tone and image of the next line to be printed, is transported into the transfer process station 9, the recording carrier 6 is advanced by one line spacing or by a multiple. The powder image transferred onto the recording carrier, which can still be obliterated, is subsequently fixed with the aid of, for example, heat and pressure in a fixing station which is not illustrated in FIG. 1.

In order to bring about a direct contact of the intermediate carrier 1 with the recording carrier 6 during the transfer process, the intermediate carrier 1 is moved into contact with the recording carrier 6, for a very short period of time, with the aid of a bar 12. The recording carrier is therefore supported against a stationary strip 13, which is arranged on the opposite side of the intermediate carrier. Therefore, the recording carrier 6 travels between the bar 12 and perpendicularly thereto.

In order to transfer toner images, the bar 12 is moved toward the strip 13, and the intermediate carrier 1 is brought into contact with the recording carrier 6. The device for moving the bar 12 toward the strip 13 can be designed in various ways.

A first embodiment of apparatus for moving the intermediate carrier toward the recording carrier is illustrated in FIG. 1. For this purpose, at least two electromagnets 14 are provided, each of which has an armature 22 attached to the bar 12. If the bar 12 is to be moved toward the strip 13, the electromagnets 14 are energized, the armatures 22 are drawn into the magnets 14, whereby the bar 12 is moved in the direction toward the strip 13. After the excitation of the electromagnets 14 is cut off, the bar 12 is then brought back into its rest position with the aid of a plurality of springs 15.

Figure 2:
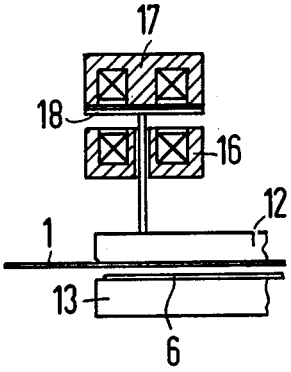
FIG. 2 is a schematic diagram which illustrates a second embodiment of the device for moving the bar.
Figure 3:
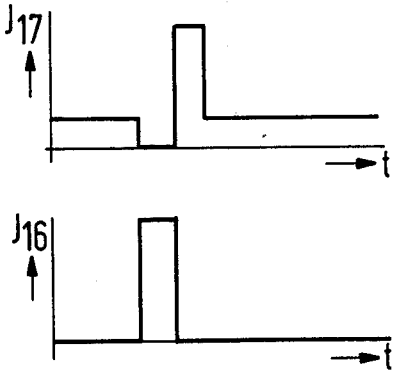
FIG. 3 is a current diagram, with respect to time, of the currents flowing through the electromagnetic arrangement.

In another embodiment, the device for moving the bar 12 comprises at least two electromagnet arrangements. As illustrated in FIG. 2, each electromagnet arrangement comprises a pressure magnet 16, a return magnet 18 and a common armature 18 which is hinged to the bar 12. In the rest position, the return magnets 17 are traversed by a weak current $I_{17}$, as illustrated in FIG. 3. If the toner image is to be transferred from the intermediate carrier onto the recording carrier, a current pulse $I_{16}$ is provided to the pressure magnets 16—with a simultaneous cutting-off of the current for the return magnet 17—for such a duration that the bar 12 securely strikes the recording carrier and the stationary strip. After completion of the current pulse $I_{16}$ for the pressure magnets 16, a current pulse is fed to the return magnets 17, and the return magnets return the bar into its rest position. After a length of time sufficient for the return process, the current $I_{17}$ is again decreased to a lesser value sufficient for holding the bar 12 in its rest position.

Particularly short operating and release times can be obtained with the electromagnetic arrangement illustrated and explained with respect to FIGS. 2 and 3. It is thereby possible to hold the contact interval between the intermediate carrier and the recording carrier short.

The portion of the intermediate carrier 1, which is located in the area of the bar, is temporarily brought to a standstill during the contacting operation. Whereas the remaining length of the intermediate carrier 1 is transported further by means of the drive wheel 2. Thereby, the portion of the intermediate carrier 1, located between the right-end of the bar 12 and the drive wheel 2, is necessarily stretched, whereas the part of the intermediate carrier located between the left-hand end of the bar 12 and the drive wheel 2 is relaxed. Therefore, the intermediate carrier must be sufficiently elastic so that during stretching and relaxing of the intermediate carrier no damage can occur to the intermediate carrier. However, synthetic materials which can fulfill this requirement are well known in the art, for example polyethyleneterephthalate.

It is advantageous to bring the portion of the intermediate carrier involved in the transfer process to a temporary standstill before contact thereof with the recording carrier, and to not bring that portion again into motion in its direction of travel to a short time after completion of the contact. With this type of operation, blurring of the toner image which could occur in the transition phase between noncontact and contact by means of slipping of the intermediate carrier vis-a-vis the recording carrier, when the printing speed is great, are avoided. In order to obtain this feature, a braking member can be arranged in the strip 20 which is located adjacent the recording carrier 6 and which projects over the surface of the recording carrier in the rest position.

Figure 4:
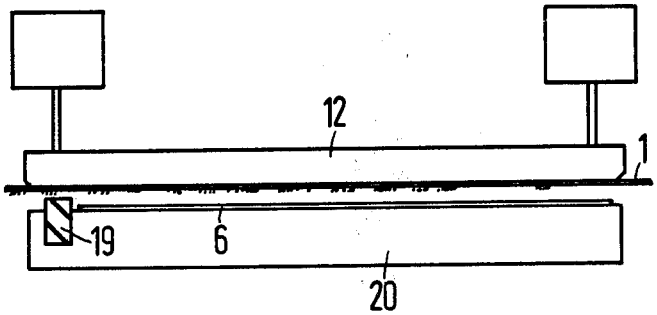
FIG. 4 diagrammatically illustrates the transfer process station utilizing a braking member.

A first exemplary embodiment of such a braking member is illustrated in FIG. 4. In this embodiment, a braking member 19 comprises an elastic material, for example a synthetic material, which is fixed to the strip 20 such that it projects over the surface of the recording carrier 6 in the rest position. When pressing against the bar 12, the braking member 19 receives contact with the intermediate carrier 1 and brakes the carrier to a standstill even before the bar contacts the recording carrier 6, with a progressive pressure process. Accordingly, during the movement of the bar away from the material, the braking of the intermediate carrier 1 is retained for an interval until an air gap between the recording carrier and the intermediate carrier is formed and an obliteration is thus avoided.

Figure 6:
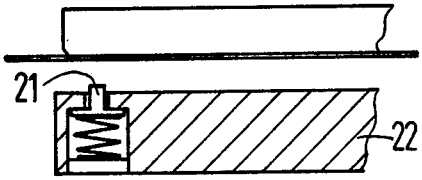
FIG. 6 schematically illustrates a second embodiment of a braking member.

FIG. 6 illustrates another embodiment of a braking member constructed in accordance with the present invention. In FIG. 6 a metal block 21, spring supported in the strip 22, is used as a braking member.

Figure 5:
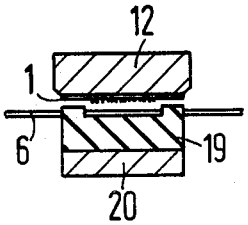
FIG. 5 illustrates an embodiment of a braking member on the side facing the intermediate carrier.

It is expedient to design the side of the braking members 19, 21 facing the intermediate carrier in a fork shape. Such an embodiment is illustrated in FIG. 5 which is a sectional view through the braking member 19 of FIG. 4. FIG. 5 illustrates that the braking member 19 only contacts the areas of the intermediate carrier 1 which do not bear toner characters, this contact occurring only during the transfer process. Therefore, an obliteration of the toner image by the braking member is avoided.

An electric voltage or a magnetic field can be applied between the bar 12 and the stationary bar 13 for supporting the transfer process, whereby an attractive force is exerted toward the toner in the direction of the recording carrier 6.

Although we have described our invention by reference to particular illustrative embodiments thereof, many changes and modifications of the invention may become apparent to those skilled in the art without departing from the spirit and scope of the invention. Therefore, we intend to include within the patent warranted hereon all such changes and modifications as may reasonably and properly be included within the scope of our contribution to the art.

We claim:

1. A device for use during the transfer of toner characters to a recording carrier, comprising:
   an intermediate carrier, said intermediate carrier comprising a continuously rotating two surface elastic band disposed adjacent the recording carrier and bearing toner characters on the surface which faces the recording carrier; and
   clamping means for temporarily clamping said band to the recording carrier during the transfer process so that the area of the band which is in contact with the recording carrier comes to a temporary standstill.

2. The device of claim 1, wherein said clamping means comprises:
   a stationary bar on one side of the intermediate carrier;
   a movably mounted bar on the other side of the intermediate carrier with the recording carrier between one of the bars and the intermediate carrier; and
   means for moving said movably mounted bar toward and away from said strip to temporarily clamp said intermediate carrier to the recording carrier.

3. The device of claim 2, wherein said stationary bar supports the recording carrier and said movably mounted bar is located adjacent the surface of said intermediate carrier which does not have toner characters thereon.

4. The device of claim 2, wherein said means for moving said movably mounted bar comprises:
   at least two electromagnets each including an armature connected to said movably mounted bar and operable to move said bar in one direction; and
   spring means connected to said bar for moving said bar in the opposite direction.

5. The device of claim 2, wherein said stationary bar includes:
   a brake member of elastic material extending adjacent the edge of and beyond the recording carrier in the non-clamping condition.

6. The device of claim 2, wherein said means for moving said movably mounted bar comprises:
   at least two electromagnets, each of said electromagnets including an armature connected to said bar, a first winding energizable with a current pulse to move said bar in said one direction, and a second winding energizable with a current pulse of a first level to move said bar in said opposite direction and by a subsequent constant current of a second, lower level to maintain said bar in a rest position.

7. The device of claim 6, wherein said brake member is forked-shaped so as to span the surface area of the intermediate carrier which bears toner characters and contacts the carrier outside of that surface area.

8. The device of claim 2, wherein said stationary bar includes:
   a brake comprising a metal block brake member adjacent the edge of the recording carrier and a spring biasing said metal block brake member to a position beyond the recording carrier during a non-clamping condition.

9. The device of claim 8, wherein said brake member is forked-shaped so as to span the surface area of the intermediate carrier which bears toner characters and contacts the carrier outside of that surface area.

10. The device of claim 2, comprising:
   means for applying an electric voltage across said bars to support the transfer process.

11. The device of claim 2, comprising:
   means for applying a magnetic field across said bars to support the transfer process.

12. A recording process comprising the steps of:
   supporting a recording carrier at a work station;
   continuously moving an endless elastic band adjacent the recording carrier;
   applying toner characters to an area on the surface of the band facing the recording carrier;
   clamping the toner bearing area of the band and the recording carrier together, without stopping the continuous movement of the band, to bring the area to a standstill;
   transferring the toner characters from the area of the band to the recording carrier; and then
   releasing the band area so that it is free to move with the remainder of the band.

13. The process of claim 12, comprising the further steps of:
   braking the toner bearing area of the band prior to contact thereof with the recording carrier; and
   releasing the brake after the area and recording carrier disengage their contact to prevent smudging.

14. In apparatus for a recording process in which an endless band moves over a recording carrier, at a work station, in which the band has a surface area bearing toner characters, in which the band is temporarily stopped and clamped to the recording carrier while the toner characters are transferred to the recording carrier, the improvement wherein:
   said band is an elastic band;
   means continuously move said band; and
   means at the work station temporarily brake and contact the toner bearing area to the recording carrier.

* * * * *